US005673078A

United States Patent [19]

Wen et al.

[11] Patent Number: 5,673,078

[45] Date of Patent: Sep. 30, 1997

[54] THERMAL PRINTER AND COMPLIANT PLATEN FOR A THERMAL PRINTER

[75] Inventors: Xin Wen, Rochester; Joseph C. Olsovsky, North Chili, both of N.Y.

[73] Assignee: Eastman Kodak Company, Rochester, N.Y.

[21] Appl. No.: 669,020

[22] Filed: Jun. 24, 1996

[51] Int. Cl.[6] ..... B41J 11/02; B41J 11/04; B41J 11/057

[52] U.S. Cl. ..... 347/220; 400/662

[58] Field of Search ..... 347/220; 400/662

[56] References Cited

FOREIGN PATENT DOCUMENTS

| | | | |
|---|---|---|---|
| 55-144183 | 11/1980 | Japan | 347/220 |
| 56-004484 | 1/1981 | Japan | 347/220 |
| 61-054967 | 3/1986 | Japan | 400/662 |

OTHER PUBLICATIONS

U.S. Patent Application Serial No. 08/641,250, filed Apr. 30, 1996.

*Primary Examiner*—Huan H. Tran
*Attorney, Agent, or Firm*—Milton S. Sales

[57] ABSTRACT

A platen roller for a thermal printer includes a compliant base material having a network stretch-resistant material embedded in it. The stretch-resistant material is preferably a network of nonwoven nylon, woven polyester, woven fiberglass, or similar structure which resists shear forces in a platen roller that transports a receiver through a nip in contact with a donor, which, in turn, is contacted by a thermal head. The reduction in shear forces improves the registration of color images in making a quality multicolor image.

22 Claims, 1 Drawing Sheet

THERMAL PRINTER AND COMPLIANT PLATEN FOR A THERMAL PRINTER

This invention relates to thermal printing, and, more particularly, to thermal printing of the type in which a donor and receiver are fed between a thermal head and a compliant platen for imagewise transfer of image material contained on the donor to the receiver. It is particularly useful in a printer in which successive dye images in different colors are transferred to the receiver in registration to form a multicolor dye image on the receiver.

In a thermal printer a receiver sheet or web and a donor sheet or web are fed together through a printing nip between a thermal printhead and a rotatable platen. The printhead imagewise heats the donor to transfer dye or a similar material in image configuration to the receiver as the donor and receiver pass through the nip. To make multicolor images, the receiver is passed again through the nip with a different color donor.

U.S. patent application Ser. No. 08/641,250, filed in the name of Maslanka, Fisher and Kordovich Apr. 30, 1996, and entitled THERMAL PRINTER WHICH RECIRCULATES RECEIVER SHEET BETWEEN SUCCESSIVE PRINTING PASSES, describes a thermal printer in which the receiver is moved through a closed loop path to accomplish a plurality of passes through a nip between a thermal head and a platen roller. In many prior devices, transport through the nip is accomplished by pinch rollers downstream of the nip with a platen roller being driven frictionally by the receiver. In this application the pinch rollers are eliminated, and the platen roller itself drives the receiver and donor through the nip, simplifying the apparatus.

Good registration of the images is affected by the shape and the movement of the platen roller, which has an elastomeric layer. The shape and the movement of the platen roller, in turn, is affected by substantial pressure from the thermal printhead, which ensures good contact between the donor and receiver during printing. The pressure produces a frictional force at the printhead-donor interface. The pressure and the frictional force generate temporary deformation (sometimes called "wind-up") in the platen roller. The wind-up includes bulging near the printhead as well as shear in the elastomeric layer from the outer surface to the core of the platen roller. Since the frictional force at the donor-printhead interface depends on localized temperature, which, in turn, depends on the image content being printed, the degree of shear and bulging varies color-to-color, which causes color misregistration.

SUMMARY OF THE INVENTION

It is an object of the invention to improve the registration of a multicolor thermal printer that includes a platen roller, especially a receiver driving platen roller.

This and other objects are accomplished by a thermal printer that includes a platen roller, and a thermal head forming a transfer nip with the platen roller. The platen roller includes a compliant base material such as silicone rubber or polyurethane and a stretch-resistant but compressible material to increase the shear stability of the platen roller.

Preferably, the stretch-resistant material is a network material, for example, a network or mesh of nylon, woven polyester or woven fiberglass, which material allows the roller to be compressed in response to pressure from the printhead but resists sidewise moving and bulging of the roller and, thereby greatly reduces its susceptibility to shear.

It is also an object of the invention to provide a platen roller usable in a thermal printer of the type described.

DETAILED DESCRIPTION OF THE INVENTION

Although this invention can be used in any thermal printer which includes a platen roller, including those in which the drive is actually accomplished by a pair of pinch rollers generally positioned downstream from the nip, it provides its most remarkable advantages when used with a platen roller in which transport of the receiver is accomplished by the platen roller itself.

Figure 1:
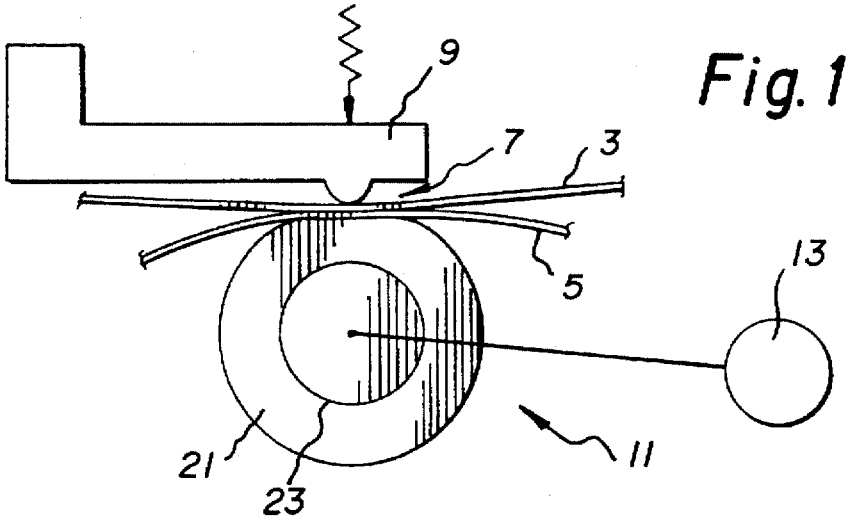
FIG. 1 is a side schematic of the printing portion of a thermal printer.

Such a thermal printer is illustrated in FIG. 1 in which a dye donor sheet or web 3 (sometimes herein just called "donor") and a receiver sheet or web 5 (sometimes herein called "receiver") are transported through a nip 7 formed by a thermal printhead 9 and a platen roller 11. The platen roller is rotated by a motor 13 to drive the receiver through the nip.

While in the nip, a thermal printhead 9 imagewise heats the donor 3 which causes the dye on donor 3 to transfer in image configuration to the receiver 5. The receiver 5 is recirculated, for example, by going through a closed loop or by being moved reciprocally to pass again through nip 7 but contacting a different portion of the donor 3. In each additional pass a different colored dye is transferred in image configuration to receiver 5. When done precisely, an extremely high quality multicolor print is formed.

Registration between color images on the receiver 5 is critical to the quality of the image. In the printer shown in FIG. 1, the platen roller 11 provides two important functions. First, it provides compliance in the nip so that images can be printed uniformly on the receiver. Secondly, it provides reliable receiver transport that is repeatable for each image to provide the registration required for the desired resolution of the final image. Because the receiver 5 is not held by pinch rollers or a clamp, misregistration tends to occur between color images with a device in which the platen roller provides transport through the nip. A platen roller in a thermal printer is typically comprised of a rigid shaft, usually made of metal, for mechanical strength, and an elastomer layer wrapped around the shaft for compliance. The color misregistration in platen drive thermal printers originates from the sensitivity of the elastomer layer to external force variations. Because the image densities are different between color images, different amounts of heat are applied to the different images. The difference in printing temperatures affects the friction coefficient at the printhead-donor interface which leads to variations in the resistive forces on the donor, the receiver and the platen roller. This variation in resistive forces produces a different amount of shear distortion (sometimes called "windup") in the elastomer layer on the platen roller, which leads to different movement in the receiver relative to the printhead for the different color images. This, in turn, creates color misregistration, which can ruin the image.

In prior devices, misregistration in the platen drive thermal printer is improved by increasing the resistance to shear in the platen roller by increasing the shear modulus of the rubber material. However, this is usually accomplished by an increase in the compressional modulus, which means decreased compliance of the nip interface and reduced printing uniformity.

Figure 2:
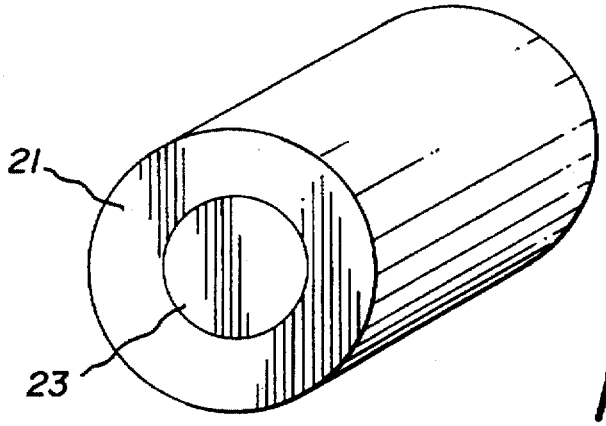
FIG. 2 is a schematic perspective section of a platen roller.
Figure 3:
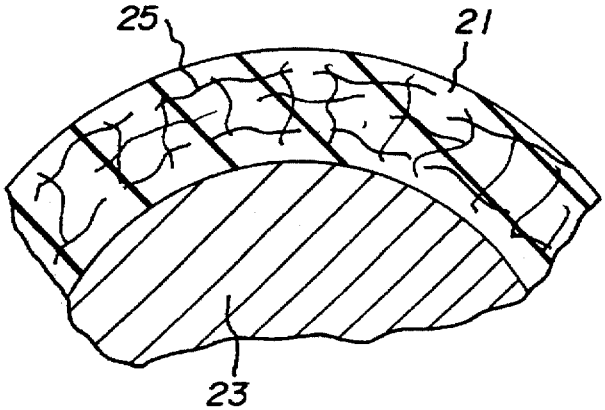
FIG. 3 is a schematic side section of part of a platen roller in the present invention.

According to the invention, this problem is solved by constructing a platen roller 11 which includes a relatively soft elastomeric layer 21 (FIGS. 1–3) formed on a metallic shaft 23. A stretch-resistant network material 25 (FIG. 3) is embedded in the elastomeric layer 21. The elastomeric material provides the compressional compliance needed for print uniformity. The stretch-resistant material is preferably a network of firmly linked strands of a material such as nonwoven, unstretchable nylon. When the elastomeric layer is under a shear torque between the metal shaft and the receiver, some part of the elastomeric layer is stretched. The resistance to stretch in the network reduces the shear displacement in the elastomeric layer. As a result, transport of the receiver is more uniform, and color registration is improved.

For example, a 1.27 cm (0.5 inch) diameter steel shaft is covered by an 0.267 cm (0.105 inch) thick elastomeric layer wrapped around the steel shaft. The elastomeric layer includes a substrate of silicone elastomer with a nylon network embedded in it. The silicone elastomer is compliant in the range of 5 to 60 Shore A durometer, preferably, 10to 45 Shore A durometer. A network of nonwoven nylon is embedded in the silicone elastomer substrate. The network is much more resistant to stretch distortion than silicone elastomer.

Other materials with these properties could also be used. For example, polyurethane, natural rubber or a similarly compliant elastomeric material could be used in place of the silicone elastomer. The network material can be, in addition to a nonwoven nylon network, a similar network of woven polyester or woven fiberglass, or other similar compressible structures that resist stretching.

The platen roller described can be manufactured by a number of processes, for example:

1. Position a metal shaft in a mold having a diameter smaller than the final desired diameter of the roller;
2. Transfer a melt of the elastomeric substrate into the mold;
3. Vulcanize the elastomer in the mold with heat;
4. Apply primer, if needed, then fabricate the network material around the elastomeric material and place the combination in a mold having the desired outside diameter;
5. Transfer more of the elastomeric material into the mold;
6. Vulcanize the combination in the mold; and
7. Heat cure the roller to increase adhesion of the materials, if applicable.

The above process forms a roller which has a tendency to be somewhat layered but still provides substantial improvement in registration when used in a thermal printer of the type shown in FIG. 1.

For ease of manufacturing, it is sometimes desirable to extrude the composite elastomer material to form the final platen roller in one step. This is accomplished by an alternative process as follows:

1. Position a metal shaft in a mold having the final diameter of the platen roller;
2. Prepare the soft elastomeric material in a melt form;
3. Prepare a melt form of the material that will form the network component in the final product. Note at this point this material is a fluid of individual polymers, molecules, fibers, or strands. The network is not yet formed;
4. Prepare a cross-linking material for the network material in fluid form;
5. Mix the above three melts homogeneously immediately before extrusion;
6. Transfer the mixed melt into the mold prepared in 1;
7. Hold for the crosslinking of the network to occur in the melt of the elastomeric material. After the completion of this step, the network is bound together, but the elastomeric material is still in melt form; and
8. Vulcanize the elastomeric material in the mold. Both the elastomeric and the network materials are now "solidified."

The above process tends to form a homogeneous composite material with the network spread in three dimensions within the soft substrate material. Step 4 provides a network of the stretch resistant material. A interconnected network, while preferable, is not necessary. Stretch resistant fibers or strands that are not linked to adjacent fibers or strands will also resist shear forces and improve registration. Thus, step 4 can be eliminated and registration still improved over the base elastomeric material used alone.

Other processes known in the elastomeric roller manufacturing art such as extrusion can be used to manufacture the roller described herein.

The invention has been described in detail with particular reference to a preferred embodiment thereof, but it will be understood that variations and modifications can be effected within the spirit and scope of the invention as described hereinabove and as defined in the appended claims.

We claim:

1. A thermal printer comprising:

a platen member, and a thermal head forming a dye transfer nip with the platen member, wherein the platen member includes a compliant material and a network of linked strands of stretch-resistant material embedded in the compliant material.

2. A thermal printer according to claim 1 wherein the compliant material has a Shore A durometer less than 60.

3. A thermal printer according to claim 1 wherein the compliant material has a Shore A durometer between 10 and 45.

4. A thermal printer according to claim 1 wherein the compliant material is a silicone elastomer.

5. A thermal printer according to claim 1 wherein the compliant material is a polyurethane.

6. A thermal printer according to claim 1 wherein the network material is a network of nonwoven nylon.

7. A thermal printer according to claim 1 wherein the network material is a network of woven polyester or of woven fiberglass.

8. A thermal printer of the type in which a dye donor and a receiver are fed in contact through a pressure nip, while being imagewise heated to transfer dye in image configuration from the donor to the receiver, said printer comprising:

a thermal head, a platen roller positioned to form said pressure nip with the thermal head, and means for driving the platen roller to move the receiver through the nip, wherein the platen roller includes a compliant material and a network of linked strands of stretch-resistant material embedded in the compliant material.

9. A thermal printer according to claim 8 wherein the compliant material has a Shore A durometer less than 60.

10. A thermal printer according to claim 8 wherein the compliant material has a Shore A durometer between 10 and 45.

11. A thermal printer according to claim 8 wherein the compliant material is a silicone elastomer.

12. A thermal printer according to claim 8 wherein the compliant material is a polyurethane.

13. A thermal printer according to claim 8 wherein the network material is a network of nonwoven nylon.

14. A thermal printer according to claim 8 wherein the network material is a network of woven polyester or of woven fiberglass.

15. A platen roller for a thermal printer of the type in which a donor sheet and a receiver are fed in contact through a pressure nip while being imagewise heated to transfer material in image configuration from the donor to the receiver, said platen roller comprising a compliant layer made up of a compliant material and a network of linked strands of stretch-resistant material embedded in the compliant material.

16. A platen roller according to claim 15 wherein the compliant material has a Shore A durometer less than 60.

17. A platen roller according to claim 15 wherein the compliant material has a Shore A durometer between 10 and 45.

18. A platen roller according to claim 15 wherein the compliant material is a silicone elastomer.

19. A platen roller according to claim 15 wherein the compliant material is a polyurethane.

20. A platen roller according to claim 15 wherein the network material is a network of nonwoven nylon.

21. A platen roller according to claim 15 wherein the network material is a network of woven polyester or of woven fiberglass.

22. A platen roller according to claim 17 wherein the compliant layer is a silicone elastomer and the network material is a network of nonwoven nylon.

* * * * *